US005273280A

United States Patent [19]

Lo

[11] Patent Number: 5,273,280

[45] Date of Patent: Dec. 28, 1993

[54] GOLF CLUB CONSTRUCTION

[76] Inventor: Kun-Nan Lo, No. 33, Hsiang-Ho Rd., Li-Lin Tsun, Tan-Tsu Hsiang, Taichung Hsien, Taiwan

[21] Appl. No.: 605,689

[22] Filed: Oct. 30, 1990

[30] Foreign Application Priority Data

Aug. 27, 1990 [TW] Taiwan ..... 79209542

[51] Int. Cl.[5] ..... A63B 53/02

[52] U.S. Cl. ..... 273/80.3; 273/80.8; 273/DIG. 23

[58] Field of Search ..... 273/167-175, 273/80.2-80.9, DIG. 7, DIG. 23, 77 R

[56] References Cited

U.S. PATENT DOCUMENTS

| | | | |
|---|---|---|---|
| 1,553,867 | 9/1925 | Maas | 273/80.3 |
| 1,636,514 | 7/1927 | Jahant | 273/80.3 |
| 1,997,889 | 4/1935 | Smith | 273/80.3 |
| 2,452,100 | 10/1948 | Campbell | 273/80.8 |
| 2,686,056 | 8/1954 | Oquist | 273/80.7 |
| 3,140,094 | 7/1964 | Hings | 273/80.3 |
| 3,266,805 | 8/1966 | Bulla | 273/80.8 |
| 3,873,090 | 3/1975 | Thompson | 273/80.8 |
| 4,664,383 | 5/1987 | Aizawa | 273/80.3 X |
| 4,936,582 | 6/1990 | Bernstein | 273/80.2 X |
| 4,948,132 | 8/1990 | Wharton | 273/80.1 |
| 4,991,843 | 3/1991 | Mori | 273/80.3 |

FOREIGN PATENT DOCUMENTS

| | | | |
|---|---|---|---|
| 397252 | 8/1933 | United Kingdom | 273/80.3 |
| 499155 | 1/1939 | United Kingdom | 273/80.3 |
| 955212 | 4/1964 | United Kingdom | 273/80.3 |
| 1201648 | 8/1970 | United Kingdom | 273/80 R |

*Primary Examiner*—V. Millin
*Assistant Examiner*—Sebastiano Passaniti
*Attorney, Agent, or Firm*—Brooks & Kushman

[57] ABSTRACT

In a golf club, the neck between the shaft and the head is strengthened by integrally forming the head and the shaft in a single mold so that the golf club is a one piece molded body. Alternatively, a separate shaft and head can be joined to one another and the joint formed therebetween is wrapped around with a resin impregnated fibrous material which will then be cohesively bonded to the shaft and the head after application of heat.

1 Claim, 4 Drawing Sheets

GOLF CLUB CONSTRUCTION

BACKGROUND OF THE INVENTION

This invention relates to a golf club construction, and particularly to the neck portion of a golf club which interconnects the head and the shaft of the golf club.

Conventionally, the head of a golf club is connected to the shaft by receiving one end of the shaft in the socket of a neck portion of the head and applying an adhesive to the joint of the neck and the shaft. Generally, the club heads are made of wood, or metals such as stainless steel and other alloys, or composite plastic materials such as fiber reinforced plastics. However, the shafts are never wooden anymore.

Metallic club heads are generally strong, hard and tough. Such heads are connected to composite plastic shaft just by applying an adhesive to the joint of the shaft and the neck of the head as shown in FIG. 1. The strength of the joint depends on the total strength of the adhesive, the neck and the golf shaft.

A wooden or composite plastic head has poorer strength, hardness and toughness than metallic heads. In order to reinforce the joint of such a head and the shaft, synthetic cords are wound around the neck of the head as shown in FIG. 2 after the neck is connected to the shaft. In addition, the neck as well as the socket in the neck should be lengthened so that the shaft can extend more deeply into the head.

The joint formed by the methods mentioned above are generally liable to loosen when subjected to torsion forces created by striking balls. When the neck and the shaft are made of different materials, serious deformation might be caused at the joint. In many cases, the neck or the shaft breaks at their joint.

SUMMARY OF THE INVENTION

An object of the invention is to provide a golf club which has a strong part that interconnects the head and the shaft, which strong part is capable of enduring a large torque.

According to the present invention, a golf club construction comprises a club head and a shaft, the club head and the shaft being made of a resin impregnated fibrous material and interconnected integrally by cohesive-bonding.

In one aspect of the invention, the club head and the shaft are separate molded pieces which are joined to one another to form a neck portion therebetween, the neck portion being wrapped around with layers of the resin impregnated fibrous material, the club head, the shaft and the layers of the resin impregnated fibrous material being cohesively bonded together after application of heat.

In another aspect of the invention. the head and the shaft is a one piece molded article made from the resin impregnated fibrous material.

The present exemplary preferred embodiment will be described in detail with reference to the accompanying drawings, of which:

DETAILED DESCRIPTION OF THE PREFERRED EMBODIMENTS

Figure 1:
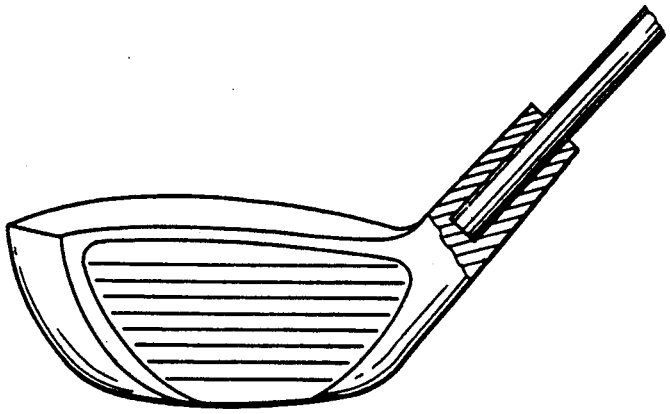
FIG. 1 PRIOR ART
FIG. 1 shows the joint of the head and the shaft of a golf club of the prior art.
Figure 2:
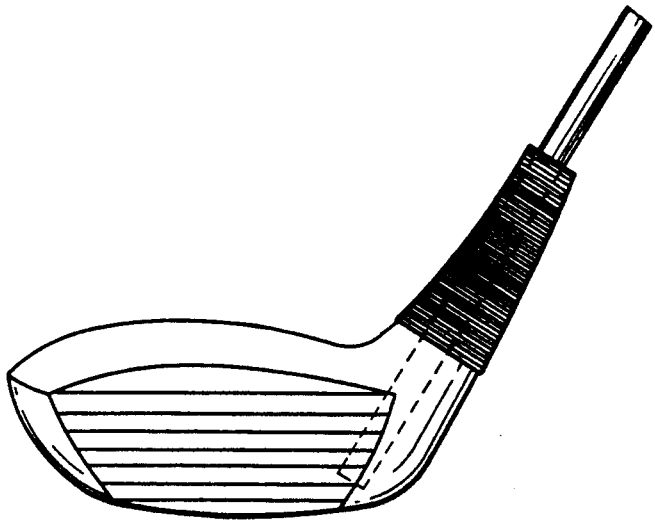
FIG. 2 PRIOR ART
FIG. 2 shows the joint of the head and the shaft of another golf club of the prior art.
Figure 3:
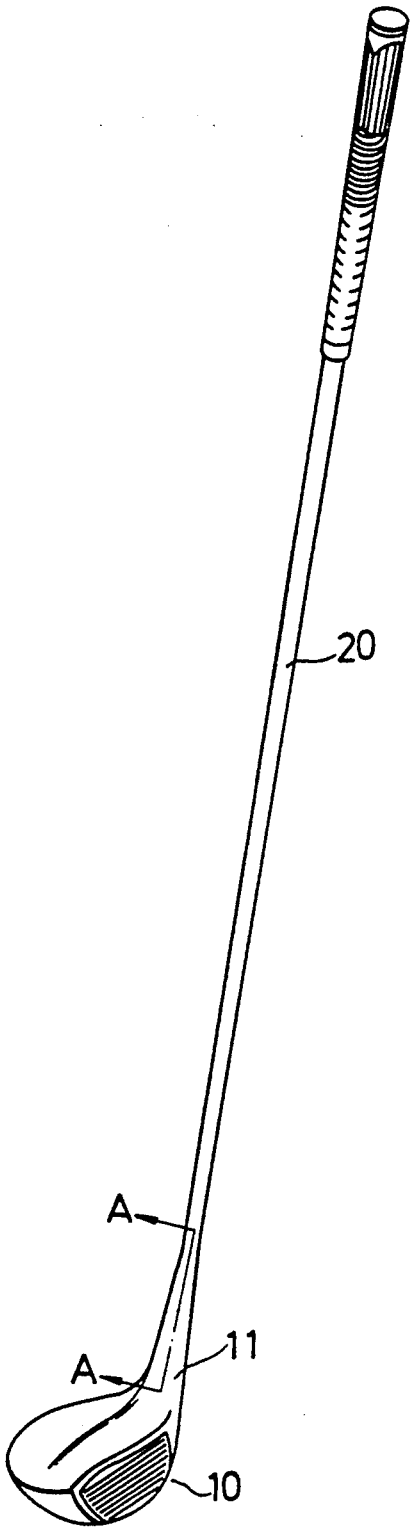
FIGS. 3 and 4 show a first embodiment of the invention.
Figure 4:
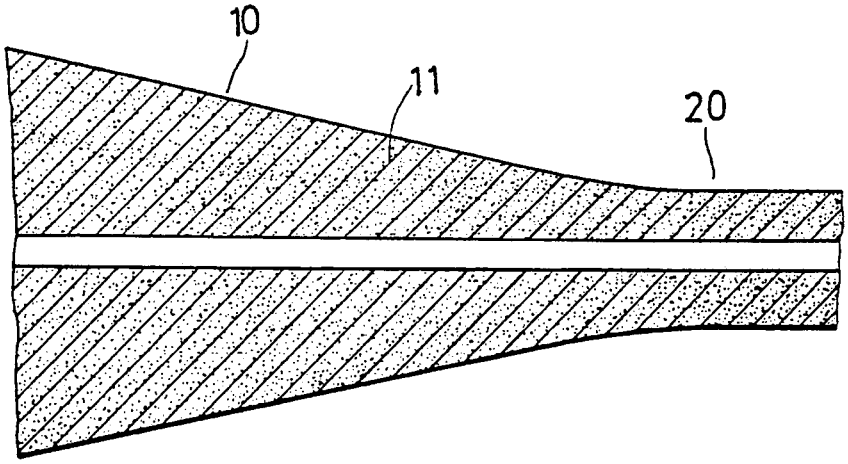

Referring to FIGS. 3 and 4, the first embodiment of the golf club of the invention includes a head 10, a neck 11 and a shaft 20 which are formed simultaneously in a mold by using a resin impregnated fibrous material, such as an epoxy resin impregnated woven or non-woven fabric. The fabric may be made of glass fibers or carbon fibers. In fabrication, the resin impregnated woven fabric layers are wrapped around a core to substantially form the shape of a golf club head including a neck in a conventional way. The shaft 20 is fabricated by wrapping resin impregnated woven fabric layers into a cylinder or other suitable form to fashion a rod continuing from the neck. During the wrapping process, the fibers of the fabric layers are oriented properly so as to achieve the maximum possible strength golf club. The resulting unfinished article is then placed in a suitable mold and heated until the resin impregnated woven fabric layers are cured. The golf club so formed has no joint between the head 10 and the shaft 20 and therefore can endures a large torque.

Figure 5:
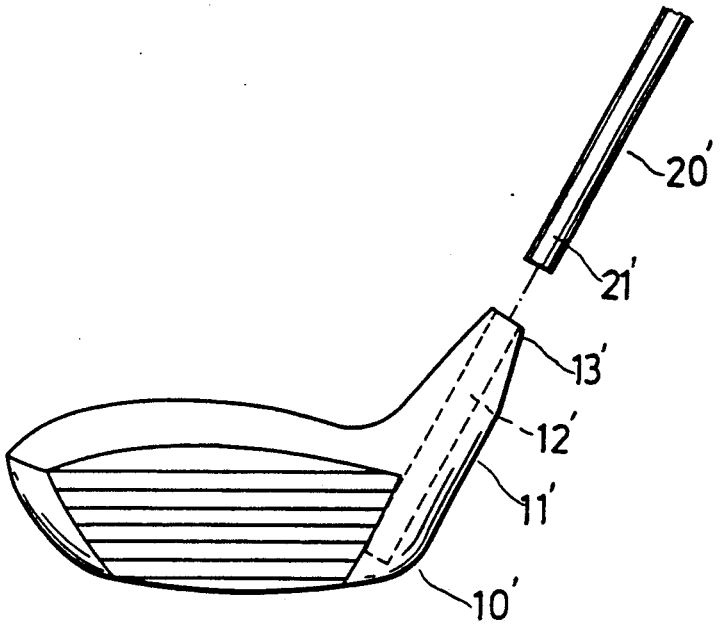
FIGS. 5 and 6 show a second embodiment of the invention.
Figure 6:
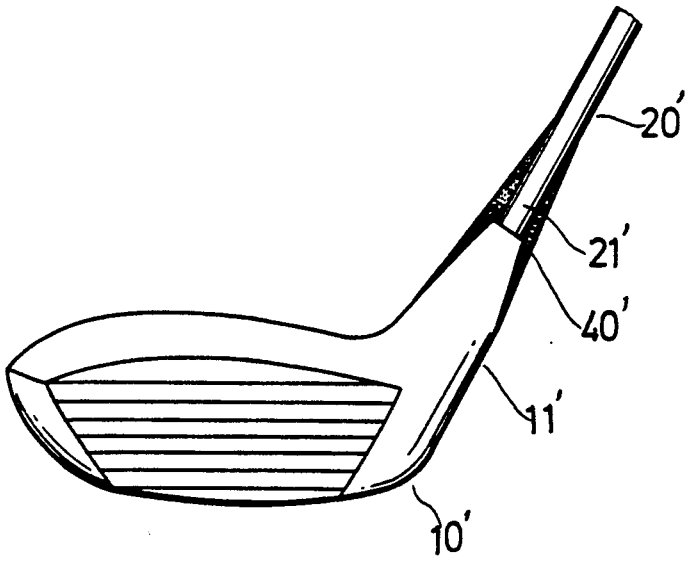

A second embodiment of the invention is shown in FIGS. 5 and 6, having a golf club head 10' with a neck 11' and a shaft 20' which are separate pieces. The head 10' and the neck 11' are fabricated by using a resin impregnated fibrous material as in the first embodiment. The shaft 20' is also fabricated by using the same material. However, the head 10' and the shaft 20' are respectively cured and formed in two molds. After the head and the shaft are fabricated, a bore 12' is provided in the neck 11'. The shaft is jointed to the neck 11' by fitting the end 21' of the shaft 20' into the bore 12'.

Afterwards, the joint of the shaft 20' and the head 10' are wrapped with a resin impregnated fibrous material 40 which may be the same as the material used to fabricate the head 10' and the shaft 20'. Then, the resin impregnated fibrous material 40 is cured by heating and pressurizing it in a suitable die. The cured resin impregnated fibrous material 40 cohesively bonded to the shaft 20' and the head 10', thereby strengthening the joint between the shaft and the head. The joint portion between the neck 11' and the shaft 20' has a gradually decreasing cross-section from the neck to the shaft as the result of the provision of the material 40.

With the invention thus explained, it is apparent that numerous modifications and variations can be made without departing from the scope of the invention. It is therefore intended that the invention be limited only as indicated in the appended claims.

I claim:

1. A golf club construction comprising a club head and a shaft, said club head having a tapering neck, said shaft having a lower end extending into said club head passing through said neck, said golf club construction further having a cured resin impregnated fibrous material wrapping around said neck and an adjacent portion of said shaft in a fashion that provides a gradually decreasing cross-section from said neck to said shaft.

* * * * *